United States Patent [19]

Linneborn

[11] 4,231,302

[45] Nov. 4, 1980

[54] APPARATUS AND PROCESS FOR BURNING OF FUELS OF RELATIVELY YOUNG GEOLOGICAL AGE AND OF ANY RESULTING GASES

[75] Inventor: Hans Linneborn, Cologne, Fed. Rep. of Germany

[73] Assignees: Albert Neuhaus-Schwermann; Walter Otto Zerbin, both of Arnsberg, Fed. Rep. of Germany

[21] Appl. No.: 38,927

[22] Filed: May 14, 1979

Related U.S. Application Data

[63] Continuation of Ser. No. 833,333, Sep. 14, 1977, abandoned.

[51] Int. Cl.[3] ..... F23G 5/12

[52] U.S. Cl. ..... 110/229; 110/210; 110/230; 110/234; 110/341

[58] Field of Search ..... 110/211, 229, 23 U, 110/234, 341, 196, 210; 48/113

[56] References Cited

U.S. PATENT DOCUMENTS

| | | | |
|---|---|---|---|
| 1,316,021 | 9/1919 | Doble | 431/10 |
| 2,354,963 | 8/1944 | Ohlsson | 110/229 |
| 2,592,730 | 4/1952 | Perkins | 110/229 |
| 3,344,758 | 10/1967 | Wotschke | 110/227 |
| 3,554,143 | 1/1971 | Rodgers et al. | 110/227 X |
| 3,707,129 | 12/1972 | Kawashimo et al. | 110/228 |
| 3,727,562 | 4/1973 | Bauer | 431/10 |
| 3,914,091 | 10/1975 | Yamagishi | 431/10 |
| 3,982,879 | 9/1976 | Pfefferle | 431/10 |
| 4,054,028 | 10/1977 | Kawaguchi | 431/10 X |
| 4,162,655 | 7/1979 | Bozdech et al. | 110/229 X |

*Primary Examiner*—Edward G. Favors

*Attorney, Agent, or Firm*—Erwin S. Teltscher

[57] ABSTRACT

A heating assembly and a method for burning fuel of organic origin, includes a substantially enclosed hollow assembly including a predetermined region within the assembly for receiving the fuel for ignition purposes, a first oxygen supply device for supplying the predetermined region with oxygen at least at a rate adequate for producing a gas flow of distilled-off gases, air gases and combustion gases from the ignited fuel, an elongated outer shell disposed within the predetermined region and having a plurality of passages for dividing the gas flow into a plurality of streamlets, an elongated inner shell, having an inlet and an outlet, disposed within the outer shell and defining a space between the inner and outer shells, the space communicating with the inlet, the streamlets being recombined into a gas stream in the space, a second oxygen supply device for supplying the inner shell with oxygen near its inlet for burning the stream of gas; and an exhaust conduit communicating with the outlet for exhausting the burnt stream from the heating assembly, so that the stream of gas remains in the heating assembly for a predetermined dwelling time, the predetermined dwelling time being substantially proportional to the sum of the lengths of the inner and outer shells.

14 Claims, 3 Drawing Figures

APPARATUS AND PROCESS FOR BURNING OF FUELS OF RELATIVELY YOUNG GEOLOGICAL AGE AND OF ANY RESULTING GASES

This is a continuation of application Ser. No. 833,333, filed on Sept. 14, 1977 now abandoned.

The present invention deals with the known matter of the pending exhaustion of all raw materials in the world, where energy carriers of solid or fluid nature, as well as fuels of a gaseous nature are particularly threatened. One is therefore forced to rely on fuels, which can be harvested in one year, or in several harvests per year, which can be constantly renewed without any apparent time limit, as long as the sun shines. To the extent that these materials cannot be used, because of their value as food for humans and animals, one nevertheless has to consider them in this connection because no plants exist which are formed exclusively of food, it being particularly appropriate to point to granular fruits, which appear always together with roots, leaves, shells, stalks, etc., and whose mass is relatively large with respect to the consumable mass, after the grains are obtained in their ripe and harvested state as food, for example in the form of edible bread. Because of this very ratio the energy stored therein from the sun is that much more valuable, particularly as nature has favored this transformation, considered from an energy point of view with a surprisingly great effectiveness. There has occured a significant change in the point of view, as a result of the previous designation of these materials as waste; today one considers them as secondary or remnant materials, such as straw obtained during the growing of wheat for bread, the straw being obtained in such large quantities, that its removal from wheat fields is obtained by burning with the aid of flame throwers. From the point of view of an economic utilization of energy, which is so to speak forced onto humanity, a misdeed has been perpetrated which can be practically designated as a crime, when one considers the annihilation of many animals including the bacteria in the earth, furthermore damage to the environment, setting and spread of fires to neighboring land, contamination of the atmosphere, and reduction of its oxygen content, increase of its carbon dioxide content, generation of nitrous vitriol, nitrogen oxide, sulphur compounds etc.

But the thermal utilization of fuels of a relatively young geological age has brought about unresolved problems, until the advent of the present invention, as it is in the nature of the characteristics of fossil fuels, the so-called coalification, to form gases during degassing, gasification and carbonization or coking, which contain vaporized particles only in small amounts, and do not have any particularly undesired properties. This does not apply for the thermal treatment of secondary or remnant materials. In the predominantly organic materials, like straw, wood, turf, skins, shells, sugar cane, wood filings, and the like, the thermal treatment connected with the generation of gas of the substrate leads already during degasing to effects, which are unknown in fossils fuels.

For example, the degasing, which can also be designated a dry distillation, is so violent, that the resulting gas cloud displaces oxygen, which is required for gasification and combustion, and which is always supplied in the form of air or air enriched with oxygen, so that the gasification process is disturbed or disadvantageously influenced. But even more disadvantageous is the appearance of heavy hydrogen carbons in the gas generated, which are precipitated in the form of tar on the surfaces, and whose temperature is below the dew point of vapors from heavy hydrocarbons. Tar, as is known, is a carcinogenic material, contact with which must be avoided for prolonged periods. Tar clings, as a result of its high viscosity, to valves, valve seats, nozzles and blade surfaces of pistons or piston engines, and turbine engines, but also to stationary heat exchanger surfaces, so that these are, or remain heat isolated, so that they can no longer fulfill their task. Equally disadvantageous is the formation of poisons in the form of phenol, phenol compounds, sulphur compounds and nitrogen derivatives in the gas generated, and during combustion of the same, in the exhaust gas generated, which therefore cannot be discharged into the atmosphere without being freed of poisons, which in turn makes the process uneconomical.

It is therefore an object of the present invention to so fashion the thermal treatment of fuels, which tend to the formation of tar and tar-like condensation products, which in turn lead to the generation of poisonous and injurious gases, so that it is possible, with the aid of purely physical, namely thermal process, and therefore practically without any need to utilize chemical materials or chemical reactions, to obtain a gas free from any poison and injurious substances, where one understands as injurious substances tar vapors and their precipitates.

It is a further object of the present invention to render the process independent of whether the gas generated is combustible or not combustible, to the extent it only satisfies the condition of a high energy content, and eherefore a high enthalpy, provided the latter is usable. The combustion of the gas is insured, if the treatment leads to the presence of a relatively high carbon monoxide content of the gas, because it is then possible to utilize the gas for not only an engine, but also for purely thermal processes, so that a higher and secondary oxidation stage, namely carbon monoxide, results.

But it is also an object of the present invention to realize a high oxidation by means of a follow-on stage, which immediately follows the generation of a combustible fuel; the products of that combustible fuel are free of any poison, tar and other injurious material, as the combustible gas already has a high enthalpy content, which in turn makes it possible to realize a high oxidation stage at a relatively low expenditure of heat or energy.

It is finally an object of the present invention to utilize the advantages of a chemical nature, which lead to the invention, without it being necessary to undertake any unusual or extreme chemical measures, in order to obtain the freedom from tar, poisons and injurious material, for the realization of which the physical and thermal proposals of the invention are sufficient in full measure. Thus it could be ascertained that during the dry distillation of straw, that distillation gases, which are denoted by the Germal technical term as "Schwelgase", and are denoted in the scientific literature as such, that they contain the extremely valuable furfurol in a relatively high measure, which is important as an initial product for many pharmaceutical and cosmetic means. This applies also for pentosane, for the low temperature tars generated by condensation of the distillation gases, which serve for the generation of valuable tar colors (page 8, paragraph 1 of the U.S. patent application) straw coal and straw coke, which as a result of their generation from straw fibers have a structure which may serve for the generation of particularly valuable active coal (disclosed on page 17, paragraph 2 of the patent U.S. application). All these possibilities and advantages are possible, by means of a process for treating fuel of organic origin in a heating assembly including first and second regions proximate to one another, the steps including placing the fuel in the first region, igniting the fuel, simultaneously supplying the fuel with first quantities of oxygen at least at a rate required for degassing and gasification, and at most at a rate required for partial combustion of the fuel thereby producing a gas flow containing distilled off gases, air gases and combustion gases, separating the gas flow into a plurality of streamlets, simultaneously segregating the streamlets from the fuel, thereafter recombining the streamlets into a gas stream, enveloping the second region with the gas stream, supplying oxygen to the second region at a rate at least adequate for burning the stream of gases, simultaneously exhausting the burnt gas stream from the second region thereby creating suction at least adequate for drawing the gas stream into the second region; and simultaneously circulating said gas stream around said second region.

The apparatus of the present invention is realized by a reactor or heating assembly for burning fuel of organic origin, which includes, according to the present invention, a substantially enclosed hollow assembly including a predetermined region within the assembly for receiving the fuel for ignition purposes, first oxygen supply means for supplying the predetermined region with oxygen at least at a rate adequate for producing a gas flow of distilled-off gases, air gases and combustion gases from the ignited fuel, an elongated outer shell disposed within the predetermined region and having a plurality of passages for dividing the gas flow into a plurality of streamlets, an elongated inner shell, having an inlet and an outlet, disposed within the outer shell and defining a space between the inner and outer shells, the space communicating with said inlet, the streamlets being recombined into a gas stream in the space, second oxygen supply means for supplying the inner shell with oxygen near its inlet for burning the stream of gas, and an exhaust conduit communicating with the outlet for exhausting the burnt stream from the heating assembly, whereby the stream of gas remains in the heating assembly for a predetermined dwelling time, the predetermined dwelling time being substantially proportional to the sum of the lengths of the inner and outer shells.

The drawing shows illustrative embodiments of equipment for carrying out the process which has been described and details of the process. In the drawing, FIG. 1 is a transverse sectional view taken on line I—I in FIG. 2 and showing equipment which embodies the invention and serves to produce a gas by a heat treatment of fuels with formation of a gas which contains hydrocarbons that have been derived from the fuel and form tarlike condensates when cooled below their dew point. The fuel may consist, e.g., of bales of compressed straw, which are indicated on the drawing.

Figure 1:
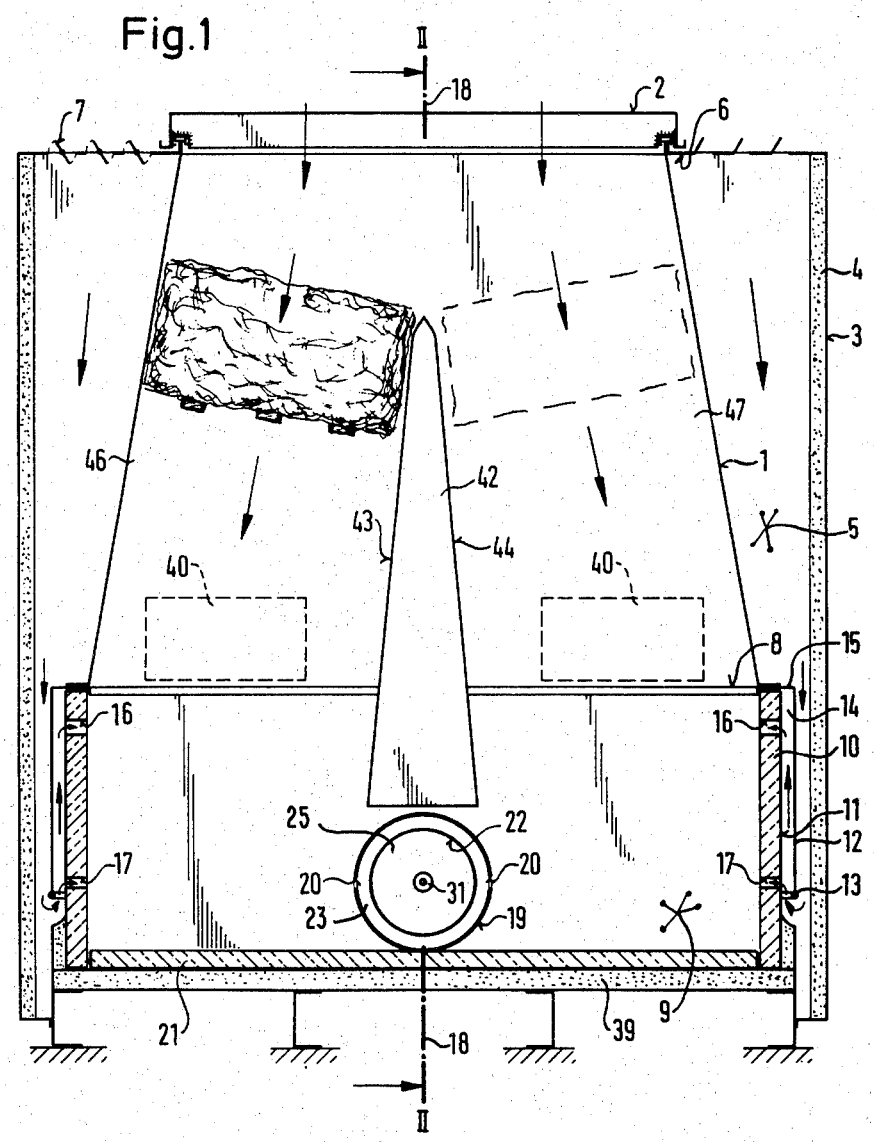
Figure 2:
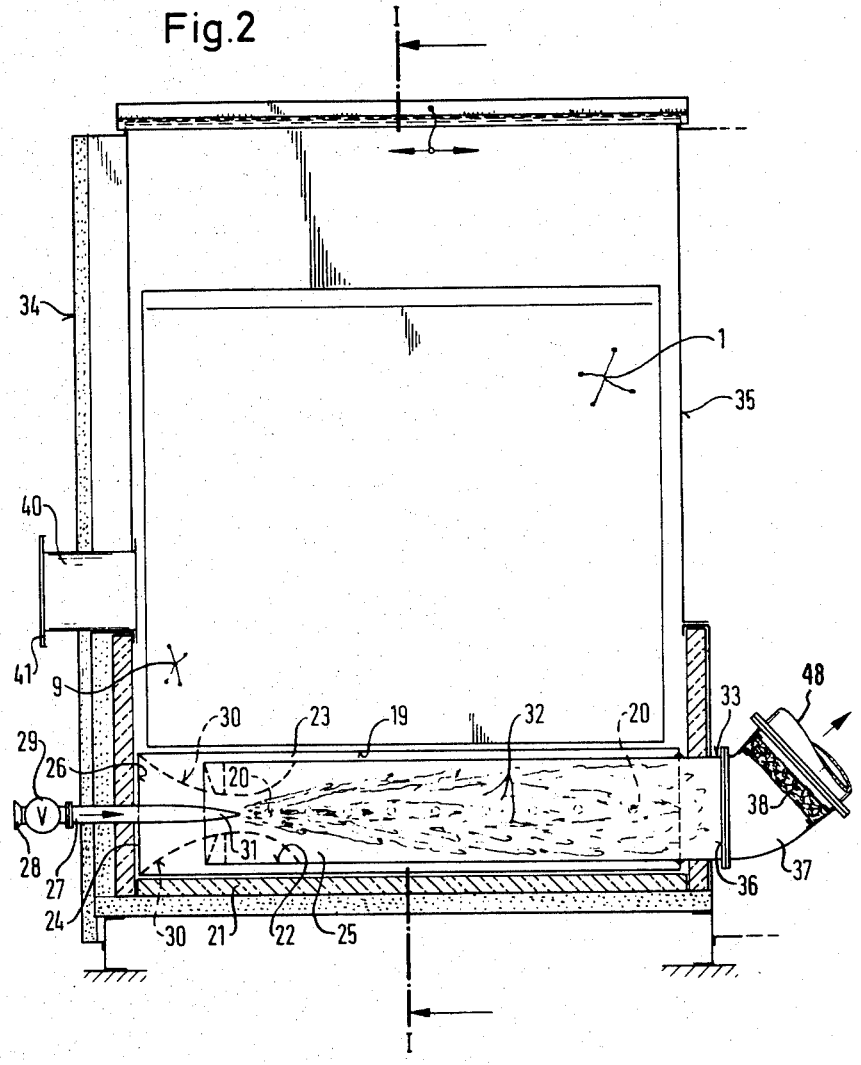
FIG. 2 is a longitudinal sectional view taken on line II—II in FIG. 1 and showing the equipment.

It is apparent from FIGS. 1 and 2 of the drawing that the equipment for heat-treating said fuels comprises fuel supply containers 1, which consist of two individual shafts, which are arranged like the legs of trousers and as shown in FIG. 2 are rectangular in cross-section each. The upper regions of the shafts join in a common rectangular fuel supply hopper, which is adapted to be closed by a cover 2, which is displaceable at right angles to the plans of the drawing of FIG. 1 on rolling elements, which may be replaced by slide rails in combination with means for lowering the cover 2 in closing position so that a seal is obtained between the cover and a flange that surrounds the common mouth of the shafts. The shaft assembly is surrounded by a reactor wall 3, which is lined by heat insulation 4. Parts 3, 4 are spaced around the shaft assembly 1 to define a space 5 which at its upper end is designed to supply a quantity of air or oxygen to a first stage. The air supply rate is suitably adjustable by means of adjustable dampers 6 or louvers 7. In the embodiment of the invention shown by way of example on the drawing, it is assumed that the fuel to be supplied to the shaft assembly 1 consists of precompacted or highly compacted bales of straw, one of which is shown because it has just entered the left-hand shaft tube. Below the bale of straw which is shown there are some diagrammatically indicated blocks of wood. It has been found that the use of such blocks of wood is suitable so that the partial quantity of air or oxygen to be supplied to the first stage can flow around each bale of straw. The lower openings of the individual shafts are held in a flange assembly 8, which merges into a hollow inner chamber 9, which defines a cavity having the same reference numeral 9. The inner chamber 9 is closed at its outside periphery by a holder 11 for refractory bricks or by a fireclay lining 10. There is also a metallic outer chamber 12, which has the shape of a downwardly open bell and is reinforced at 13 at its lower end. A jacket space 14 defined by the chambers 9, 12 is closed at its upper end by the annular flange 15. The refractory wall 10–12 which surrounds the space 9 may be replaced by a casting or by a pot of high-temperature steel and has passages 16 and 17 in the form of nozzles, specifically air nozzles, because the apertures forming said passages open into the jacket space 14, which constitutes an air supply space and which communicates with the outer shaft space 5 through the free annular cross-section that adjoins the reinforcement 13 and serves to supply air to space 14. The nozzles 16 are much larger in cross-section than the nozzles 17. The ratio of the cross-sections is about 10:1. This relationship of the cross-sections is required owing to the fact that the reactions used to produce gas fractions should take place mainly in the upper region of the space whereas in the lower region, which is supplied with less air through the nozzles 17, only those reactions are to be performed which serve to prevent in the lower region of the space 9 a retention by fuel which has not been distilled or gasified and/or burnt. Alternatively, the nozzles 16, 17 may have the same cross-sections and may be provided with mutually concentric refractory inserts in order to optimize the conditions in dependence on variables such as the nature of the fuel, its moisture content, different fuels levels in the individual shafts, etc.

The thus realizable partial gasification within the hollow space 9 of the chamber 10/11 leads to the fact that the single stream introduced in passing through the nozzle 20 and formed per nozzle 20 takes with it a series of not yet fully gasified fuel particles, so that these particles in view of the concentration in the highly heated gases in the nozzle chambers are subjected to an afterburning, so that they develop combustion heat, which counteracts the cold due to expansion, which latter must be generated in view of the transformation of pressure into velocity in the hollow chambers of the nozzle chambers 20, where one can count on the fact, or cannot exclude, that the combustion heat exceeds the heat loss due to expansion, so that the gas streams are heated in the passages of the nozzles 20, which heating extends to the vapors of heavy hydrocarbons and other injurious substances taken along, so that the cracking of the strands forming undesirable materials is insured.

Figure 3:
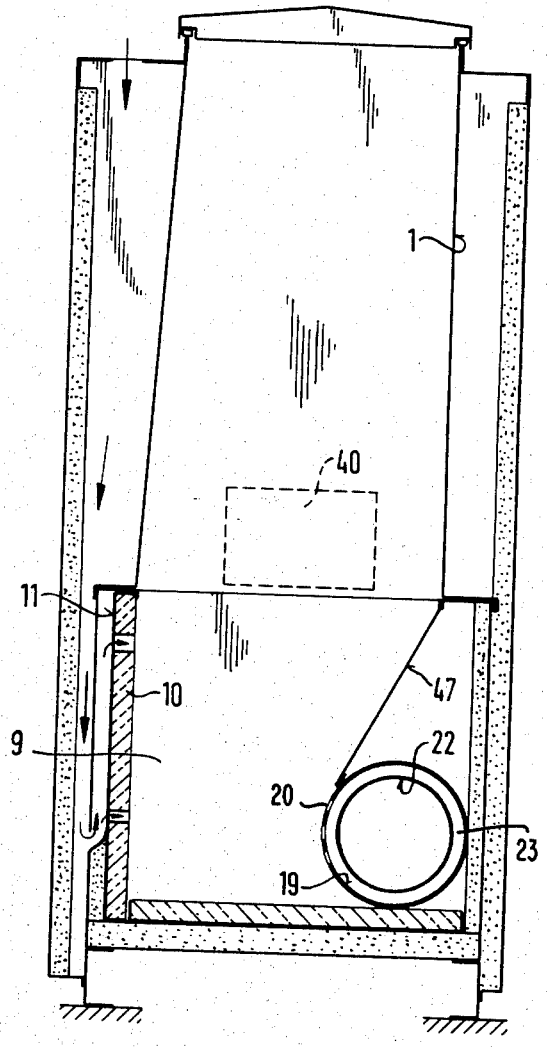
FIG. 3 shows a simplified modification of the equipment shown in FIGS. 1 and 2. This modified equipment can preferably be accommodated, e.g., in the basements of agricultural buildings because it is designed to be movable through existing door openings.

It is apparent from FIG. 1 that the equipment is symmetrical with respect to its center plane, which is designated 18 in FIG. 1, whereas the illustrative embodiment shown in FIG. 3 is asymmetrical.

The space 9 which constitutes the hollow chamber having the same designation is closed by a fixed bottom 21, which is heat-insulated. Alternatively, the bottom 21 may be double-walled and be designed, e.g., as a duct for conducting gas which has been produced. Because that gas is free from oxygen, the adjoining metallic portions cannot scale. When the equipment is supported on undisturbed soil, which should be dry, it is not necessary to provide a separate foundation nor a separate heat insulation but the gas duct thus formed may be enlarged to form a space which surrounds heat exchange means.

A hollow box extends at right angles to the plane of the drawing in FIG. 1 through the hollow chamber 9, which is identical to the space 9. In the embodiment shown by way of example, the hollow box constitutes a cylindrical tube 19. In accordance with FIG. 2, rows of nozzlelike inlets 20 are arranged in the tube wall 19. An inner tube 22 is concentric to the outer tube 19 and is described as a burner tube because the space 23 between the tube walls 19 and 22 acts as an agitating, mixing and collecting chamber, which is defined by an end wall 26. On the other hand, because the inlet nozzles 20 form constrictions owing to their smaller cross-sections of flow the outer tube 19 separates that portion of the space 9 which receives the gas fractions and is disposed outside the outer tube 19 from the agitating, mixing and collecting spaces 23. As a result, a common gas stream of the kind which is similar to the illuminating gas, town gas, coke oven gas, blast furnace gas or natural gas supplied to gas burners and which is a common gas stream because it contains all gas fractions is formed in that portion of the space 23 which is on the left in FIG. 2.

FIG. 2 of the drawing shows particularly those means, which according to the invention have been utilized, to obtain by the extension of the stream paths a temporary extension of the so-called "dwelling-time" of the gas streams within the reactor. For in order not to increase the reactor weight excessively, taking into account the propelling of vehicles by combustible or non-combustible hot gases, namely engines driven by hot air, the wall strength of the hollow tube sections 19 and 22 are made very small. Therefore the passage time of the gases through nozzles 20 is also very small, so that as a result for reasons of complete reliability it appears correct, to extend the influence of high temperatures of the gases for as long a time, as possible. This, however, can be obtained only, by the gas stream exiting from the space 23 being forced by arrangement of the open-front side 26 of the tube 19, to change its direction and to again pass into the room 25. This inversion of the gas stream leads to a doubling of the stream path and dwelling-time, without the dimensions of the reactor being made larger.

Air supply means generally designated 27 are disposed centrally with respect to the agitating and mixing chamber 23 and are preceded by an air-receiving funnel 28 and a control valve 29, which latter may be automatically controlled in dependence on a variable. The air supply means open in an air supply nozzle 31, which is disposed within the burner tube 22 so that the supply of gas which is combustible or at least contains combustible matter through the jacket space 23 and the agitating and mixing chamber, which is open to the burner tube, in conjunction with the heating of gas and air by the surrounding fuel result in the conditions required to produce a burner flame 32. Such arrangement may be described as a straw burner in analogy to a gas burner. Whereas smaller arrangements of this kind do not require additional flow-dynamical measures, these are required with larger types of straw burners. For this reason, guide walls 30 are provided, which concentrically surround the air supply means 27 and are similar to a Venturi tube and are perforated to be permeable to the gas mixture so that the latter is not only sucked by an ejectorlike action to produce a subatmospheric pressure in the reactor but the mixture formed by the gas fractions is agitated once more to provide the conditions required for the formation of the elongated burner flame 32, which fills the tube 22. The suction produced by the ejector 30, 31 might also be produced by a conventional suction blower and could be increased by a fan. The walls 34, 35 which are shown in FIG. 2 and form boundaries of the overall equipment on the left and right and also protected by insulation from heat losses. The burner tube 22 projects at 33 beyond the insulation 4 of the wall 35 so that an exhaust gas pipe for discharging the hot gases can be connected by a flange assembly 36. The exhaust gas pipe may incorporate a chamber for accommodating a catalyst 38, by which a catalytic afterburning may be effected if this is required or at least suitable.

The exhaust conduit 37 may be connected near its end 48 to a container (not shown) which accomodates heat exchangers. In this case the exhaust conduit 37 opens into the container, unless it is preferred to arrange such heat exchangers separately, e.g., behind grain-dryers, since the hot gases leaving the same still contain heat which can be utilized in heat exchangers. The inverse arrangement may also be adopted, for instance, when drying is to be effected at temperatures which for biological reasons do not exceed an upper limit of an order of 30° to 40° C. (SCHANDERL).

It is apparent from FIG. 1 that the shaft assembly comprising the two individual shafts 1 comprises also a guide body 42 for the bales of straw used as a fuel. That guide body has closed boundary surfaces 43, 44, which are inclined toward each other. The guide body 42 is disposed above the straw burner assembly 20. A different, asymmetrical arrangement of the burner assembly relative to the shaft assembly 1 is shown in FIG. 3, in which parts having the same designations are identical to the parts of the embodiment shown by way of example in FIGS. 1 and 2. For this reason there is again an inner hollow chamber, which encloses the space 9, but the outer tube 19 together with the inner tube 22 and the agitating, mixing, collecting and gas-stream-forming jacket space 23 is laterally offset from the inner hollow chamber so that a guide wall 47 is required to define for the fuel which has entered the shaft 1 the path along which the fuel is degassed or distilled, then gasified and partially burned, whereafter a mixed gas is formed and the combustible matter in the resulting gas stream is completely burnt. The tube 19 is perforated at 20.

The embodiment shown in FIG. 3 is particularly suitable for the manufacture of relatively small straw burners so that such equipment, possible with an associated heat exchanger, may be subsequently installed and may, e.g., be transported through existing doors in basements, barns, workshops, fodder-heating rooms, etc.

The dotted lines 40 in FIGS. 1 and 3 indicate passages which extend through the shaft walls and are adapted to be closed by covers 41. These passages serve, e.g., to enable the introductions of igniters, igniting torches, igniting devices or igniting materials into the shaft spaces or hollow chamber spaces, also to enable an elimination of a stagnation in the flow of fuel and to enable other necessary interventions into the degassing, distilling, gasifying, mixing and agitating processes. This relates also to the introduction of flexible suction tubes for a removal of ash. Because the heat treatment of the fuel is suitably effected, as has been described, in such a manner that all treatment spaces are subjected to subatmospheric pressure, e.g., in that the suction tube of a blower is connected to the outer jacket tube 19 or the exhaust gas tube 37, although the use of different means of subjecting the treatment spaces to subatmospheric pressure does not appear to be basically excluded, a change-over to the above-mentioned flexible suction tube will permit of a rapid withdrawal of the ash, which is particularly light in weight and easily movable in the case of straw.

The partial quantities of air or oxygen to be supplied in the first or second and, if desired, in a succeeding stage may be controlled in such a manner that a complete combustion does not result but only straw charcoal is finally produced. Owing to the chemical composition of grain straw, straw charcoal can form activated charcoal having activity properties in a degree which cannot be found, e.g., in wood charcoal. For this reason the straw charcoal which has been produced may be converted into activated charcoal so that the process which has been proposed has a previously unknown importance as a preliminary stage in the production of activated charcoal, particularly because straw charcoal can be produced first and activated charcoal can be continuously produced from straw charcoal in a fluidized-bed process.

What has been explained with reference to straw as a fuel is analogously applicable to any other fuel, which is preferably of organic origin and which tends to form tar. Shells, beans and pods are suitably bonded with the tar as a binder to form pellets. This tar may be produced, e.g., in that the measures proposed according to the invention in order to avoid a formation of tar are omitted intentionally and according to plan. Shells or peels are those of nuts, chestnuts, almonds, particularly of peanuts, the peels of potatoes, bananas, etc. Suitable beans are soybeans and suitable pods those of lupines and leguminous plants.

The reactor proposed for carrying out this process contains a hollow chamber, which in the direction of gravity succeeds shaftlike fuel containers, and a transverse tube, which extends through the hollow chamber.

In conclusion, the following remarks are made concerning the mode of operation of the equipment which has been shown on the drawings and described.

Initially, the compartments of the shaft assembly which are defined by the walls 43, 46 and 42, 47, respectively, and serve for the storage of fuel are supplied with fuel as is indicated in FIG. 1. When the plant is cold, the bales which have been charged first fall by gravity and build up first in the inner hollow chamber 9 and subsequently in the individual shaft spaces. When the cover 2 has been closed, the ignition is initiated. Igniting devices which have been incorporated in the chamber 9 may be used for this purpose. Under the action of the suction and of the supply of part of the air or part of the oxygen through the nozzles 16, 17, the ignition spreads immediately to the lowermost bales of straw so that the temperature in the inner hollow chamber 9 rises within very short time and results in degassing, dry distillation, thereafter in gasification and partial combustion. These effects are produced already in the space 9 of the inner hollow chamber, in which the resulting gas fractions begin to mix. Owing to the constrictions 2o in conjunction with the jacket space 23 which widens compared to said constrictions, the gas fractions are strongly agitated and their mixing is intensified and the gas fractions are collected. These gas fractions consist of distilled-off gases, air gases and combustion gases but still contain combustible residual gases, such as CO (carbon monoxide), hydrocarbons, and free carbon, so that the formation of the flame 32 begins in the antechamber of the combustion tube 22—this antechamber is defined by the end wall 26—in conjunction with the partial quantity of air or oxygen supplied in the second stage. The processes which have been described promote each other so that the temperature increases progressively and the delivery of hot gases through the exhaust gas pipe begins whereas there is no formation of smoke. Heat exchangers may be contacted by the hot gases and may serve to heat and, if desired, evaporate a fluid such as water which is conducted through them. Finned tubes may be used to increase the heating surface area as much as is required. Warm or hot water thus produced may either be supplied directly for various purposes, including the heating of residential and work rooms, also the supply of dry heat, which is required in large quantities for the production in agriculture, horticulture and forestry, e.g., for drying grain or animal feed, for producing dried milk, etc. It need not be emphasized that similar remarks are applicable to industrial production.

What is claimed is:

1. A heating assembly for burning fuel of organic origin, comprising, in combination:

a substantially enclosed hollow assembly including a predetermined region within said assembly for receiving the fuel for ignition purposes;

first oxygen supply means for supplying said predetermined region with oxygen at least at a rate adequate for producing a gas flow of distilled-off gases, air gases and combustion gases from the ignited fuel;

an elongated outer shell disposed within said predetermined region and having a plurality of passages for dividing said gas flow into a plurality of streamlets;

an elongated inner shell, having an inlet and an outlet, disposed within said outer shell and defining a space between said inner and outer shells, said space communicating with said inlet, said streamlets being recombined into a gas stream in said space;

second oxygen supply means for supplying said inner shell with oxygen near its inlet for burning said stream of gas; and an exhaust conduit communicating with said outlet for exhausting said burnt stream from said heating assembly, whereby said stream of gas remains in said heating assembly for a predetermined dwelling time, said predetermined dwelling time being substantially proportional to the sum of the lengths of said inner and outer shells.

2. A heating assembly as claimed in claim 1 wherein said inner and outer shells are elongated cylinders defining an elongated annular space between said shells.

3. A heating assembly as claimed in claim 1 wherein said second oxygen supply means includes a venturi tube.

4. A heating assembly as claimed in claim 1 wherein said first and second oxygen supply means are adjustable.

5. A heating assembly as claimed in claim 1 wherein said second oxygen supply means includes at least one perforated guidewall surrounding said inlet of said inner shell for guiding the oxygen into said inner shell, said stream of gas passing easily through said perforations.

6. A heating assembly as claimed in claim 1 further including a catalytic burner, and wherein said exhaust conduit is followed by, and communicates with said catalytic burner for after-burning combustible matter contained in said gas stream.

7. A heating asembly as claimed in claim 1, wherein said first oxygen supply means supplies oxygen substantially at a predetermined direction, and wherein said inner and outer shells are substantially transverse with respect to said predetermined direction of said first oxygen supply means.

8. A heating assembly as claimed in claim 1 wherein said second oxygen supply means supplies oxygen at least adequate for complete combustion of the combustible matter in said gas stream.

9. A heating assembly as claimed in claim 1, further comprising a plurality of walls at least partly surrounding said predetermined region, at least one of said walls having at least one nozzle-like passage communicating with said first oxygen supply means for supplying oxygen through said passage to said predetermined region.

10. A heating assembly as claimed in claim 9, wherein at least one of said walls has two sets of nozzle-like passages, said first set being positioned vertically above the second set, and each passage of said first set having a cross-sectional area at least as large as each passage of said second set.

11. A process for treating fuel of organic origin in a heating assembly including first and second regions proximate to one another, the steps comprising in combination:

placing the fuel in said first region;

igniting the fuel;

simultaneously supplying the fuel with first quantities of oxygen at least at a rate required for degassing and gasification, and at most at a rate required for partial combustion of the fuel thereby producing a gas flow containing distilled off gases, air gases and combustion gases;

separating said gas flow into a plurality of streamlets;

simultaneously segregating said streamlets from the fuel;

thereafter recombining said streamlets into a gas stream;

enveloping said second region with said gas stream;

supplying oxygen to said second region at a rate at least adequate for burning said gas stream;

simultaneously exhausting said burnt gas stream from said second region thereby creating suction at least adequate for drawing said gas stream into said second region; and simultaneously circulating said gas stream around said second region.

12. A process for treating fuel as claimed in claim 11 further comprising the step of catalytically afterburning the exhausted gas stream.

13. A process for treating fuel as claimed in claim 11 wherein the steps of supplying oxygen to said first and second regions are controllable.

14. A process for treating fuel as claimed in claim 11 further comprising the step of removing a portion of said gas stream from said heating assembly for independent utilization.

* * * * *